US009275600B2

(12) United States Patent
Zhu et al.

(10) Patent No.: US 9,275,600 B2
(45) Date of Patent: Mar. 1, 2016

(54) SOURCE ELECTRODE DRIVING MODULE WITH GAMMA CORRECTION AND LCD PANEL

(71) Applicant: Shenzhen China Star Optoelectronics Technology Co., Ltd., Shenzhen, Guangdong (CN)

(72) Inventors: Jiang Zhu, Shenzhen (CN); Dongsheng Guo, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 133 days.

(21) Appl. No.: 14/357,214

(22) PCT Filed: Mar. 27, 2014

(86) PCT No.: PCT/CN2014/074164

§ 371 (c)(1),
(2) Date: May 9, 2014

(87) PCT Pub. No.: WO2015/143656

PCT Pub. Date: Oct. 1, 2015

(65) Prior Publication Data

US 2015/0279300 A1 Oct. 1, 2015

(30) Foreign Application Priority Data

Mar. 25, 2014 (CN) ..... 2014 1 0114046

(51) Int. Cl.
*G09G 3/36* (2006.01)

(52) U.S. Cl.
CPC ..... *G09G 3/3696* (2013.01); *G09G 3/3688* (2013.01); *G09G 3/3614* (2013.01); *G09G 2310/027* (2013.01); *G09G 2320/0276* (2013.01); *G09G 2320/0673* (2013.01)

(58) Field of Classification Search
CPC ..... G09G 3/3696; G09G 2320/0673
See application file for complete search history.

(56) References Cited

U.S. PATENT DOCUMENTS

| | | | | |
|---|---|---|---|---|
| 7,760,178 | B2 * | 7/2010 | Takada | G09G 3/3688 345/690 |
| 8,525,765 | B2 * | 9/2013 | Kim | G09G 3/2007 345/690 |
| 2002/0158862 | A1 * | 10/2002 | Chen | G09G 3/3696 345/211 |
| 2002/0186230 | A1 * | 12/2002 | Kudo | G09G 3/3607 345/690 |
| 2007/0139328 | A1 * | 6/2007 | Lan | G09G 3/3696 345/89 |

(Continued)

FOREIGN PATENT DOCUMENTS

CN 102637402 A 8/2012

*Primary Examiner* — Gene W Lee
(74) *Attorney, Agent, or Firm* — Andrew C. Cheng

(57) ABSTRACT

The present invention discloses a source electrode driving module for providing a data signal to an LCD unit, comprising: a Gamma correction chip and a source electrode driving chip, wherein, the Gamma correction chip comprises a P-GAMMA driving chip with three to eight output channels; the P-GAMMA driving chip is used for generating multiple control voltages providing to the source electrode driving chip; the source electrode driving chip comprises a first resistor string and a second resistor string; the multiple control voltages generated by the P-GAMMA driving chip connect into the first resistor string and the second resistor string according to turning points of a Gamma curve of the LCD unit, wherein, n is an integer, and 6≤n≤10. The present also disclose an LCD panel including the source electrode driving module described above.

20 Claims, 3 Drawing Sheets

(56) References Cited

U.S. PATENT DOCUMENTS

2007/0146395 A1* 6/2007 Lee ..... G09G 3/2007 345/690
2009/0015532 A1* 1/2009 Katayama ..... G09G 3/3406 345/89
2010/0225678 A1* 9/2010 Kim ..... G09G 3/3696 345/690
2011/0032279 A1* 2/2011 Kim ..... G09G 3/2007 345/690
2013/0249969 A1* 9/2013 Jeon ..... G09G 5/10 345/691
2014/0176519 A1* 6/2014 Fu ..... G06F 1/26 345/211

* cited by examiner

SOURCE ELECTRODE DRIVING MODULE WITH GAMMA CORRECTION AND LCD PANEL

BACKGROUND OF THE INVENTION

1. Field of the Invention

The present invention relates to a liquid crystal display (LCD) device technology field, and more particularly to a source driving module of an LCD panel and an LCD panel comprises the source driving module in an LCD device.

2. Description of Related Art

The liquid crystal display (LCD) device is a flat and ultra-thin display device. It consists of a number of color or monochrome pixels, placed in front of the light source or reflect surface. The power consumption of the LCD device is very low, and it has a high-quality, small size, light weight, so that people are favored to become the mainstream display device. The current LCD device is mainly based on the thin film transistor (TFT). The LCD panel is the main component of the LCD device. The liquid crystal panel generally includes a color filter substrate and a TFT array substrate disposed oppositely and a liquid crystal layer sandwiched between the two substrates.

The driving of the LCD panel is by the gate electrode driving module and the source electrode driving module to respectively provide a scan signal and a data signal to the LCD unit. The voltage difference between different voltage of the data signal and a common electrode voltage cause the liquid crystal molecular to rotate a different angle in order to form the brightness difference. That is, the LCD panel displays with different grayscales. In the LCD panel, the relation curve between the data signal voltages and grayscales is called a Gamma curve. Using 8bit LCD panel as an example, it can display $2^8$=256 grayscales, and they are corresponding to 256 different Gamma voltages. The Gamma voltages divide the change process from white color to black color into $2^N$ equal parts.

In order to improve the display quality of the LCD panel, the Gamma correction has been widely used. In practical application, it usually selects the crucial turning points in the Gamma curve, and through adjusting the voltages of turning points to achieve adjustment of the Gamma curve. Using LCD panel with 256 grayscales as an example, in order to protect the LCD unit better, for the same display unit, it usually utilizes mutual driving method of a positive polarity voltage and a negative polarity voltage. In the Gamma curve as shown in FIG. 1, VD1~VD20 have 20 turning points (00H, 01H, 02H, 1FH, 3FH, 7FH, BFH, DFH, FEH and FFH, that is the 0, 1st, 2nd, 31rd, 63rd, 127rd, 191rd, 223rd, 254rd and 255rd grayscales) to be selected for adjusting, which is that we usually refer to 20 regulated voltages with binding. The source driving IC further generates 256 Gamma voltages according to the 20 regulated voltages to realize the display of 256 grayscales as the schematic diagram shown in FIG. 2.

In the prior art, there are two methods to generate VD1~VD20: one method is using a resistor string to divide a voltage to obtain 20 regulated voltages, and then utilizing buffer amplifier chip to amplify the driving capacity. However, the Gamma voltages generated by this method are difficult to adjust; the other method is using P-Gamma (programmable gamma correction) to implement programmable regulated voltages. The Gamma voltages generated by this method is easy to be adjusted, but using P-Gamma IC to generate 20 regulated voltages, the number of the output channels is more, and the cost is higher.

SUMMARY OF THE INVENTION

In view of the deficiencies of the prior art, an object of the present invention is to provide a source electrode driving module of an LCD panel and an LCD panel comprising the source electrode driving module, through using the P-GAMMA driving chip with fewer output channels, it can correct and generates the Gamma voltages so as to reduce the power consumption of the LCD panel, and reduce the difficulty of the driving circuit design and the fabrication process so as to save fabrication cost.

To achieve the above object, the present invention adopts the following technical solutions: a source electrode driving module for providing a data signal to a liquid crystal display (LCD) unit, comprising: a Gamma correction chip and a source electrode driving chip, wherein, the Gamma correction chip comprises a P-GAMMA driving chip with three to eight output channels; the P-GAMMA driving chip is used for generating multiple control voltages providing to the source electrode driving chip; the source electrode driving chip comprises a first resistor string and a second resistor string; the first resistor string and the second resistor string are respectively formed by $2^n-2$ resistors connected in series; the first resistor string receives a portion of the control voltages generated by the P-GAMMA driving chip, and through voltage dividing to form $2^n$ data signal voltages with positive polarity; the second resistor string receives the other portion of the control voltages generated by the P-GAMMA driving chip, and through voltage dividing to form $2^n$ data signal voltages with negative polarity; and the multiple control voltages generated by the P-GAMMA driving chip connect into the first resistor string and the second resistor string according to turning points of a Gamma curve of the LCD unit, wherein, n is an integer, and $6 \le n \le 10$.

Wherein, the number of the control voltages generated by the P-GAMMA driving chip is an even number, a half of the control voltages is used to control the data signal voltages with positive polarity, and the other half of the control voltages is used to control the data signal voltages with negative polarity such that the data signal voltages with positive polarity and the data signal voltages with negative polarity of the Gamma curve form a symmetrical relationship.

Wherein, the value of n is eight, and the data signal voltages with positive polarity are +V0~+V255, and the data signal voltages with negative polarity are −V0~V255.

Wherein, the value of n is eight, and the data signal voltages with positive polarity are +V0~+V255, and the data signal voltages with negative polarity are −V0~V255.

Wherein, the P-GAMMA driving chip has eight output channels and generates ten control voltages to input into the first resistor string and the second resistor string; wherein, the control voltage VD1 generated at the first output channel connects to a port of the +V255 data signal voltage of the first resistor string; the control voltage VD1 also connects to a ground through resistors R1, R2 and R3 connected sequentially in series; a control voltage VD3 generated at the second output channel connects to a port of the +V233 data signal voltage of the first resistor string; a control voltage VD7 generated at the third output channel connects to a port of the +V31 data signal voltage of the first resistor string; a control voltage VD9 generated at the fourth output channel connects to a port of the +V1 data signal voltage of the first resistor string; a control voltage VD10 generated at the fifth output channel connects to the a port of the +V0 data signal voltage of the first resistor string; a control voltage VD11 generated at the sixth output channel connects to a port of the −V0 data signal voltage of the second resistor string; a control voltage VD12 generated at the seventh output channel connects to a port of the −V1 data signal voltage of the second resistor string; a control voltage VD14 generated at the eighth output channel connects to a port of the −V31 data signal voltage of the second resistor string; wherein, a voltage signal which is from voltage dividing between the resistors R1 and R2 connects to an analog buffer amplifier OP1 of the source electrode driving chip to be amplified to form a control voltage VD19 and connecting to a port of the −V233 data signal voltage of the second resistor string; a voltage signal which is from voltage dividing between the resistors R2 and R3 connects to an analog buffer amplifier OP2 of the source electrode driving chip to be amplified to form a control voltage VD20 and connecting to a port of the −V255 data signal voltage of the second resistor string.

Wherein, the resistors R1, R2, and R3 are variable resistors.

Wherein, the P-GAMMA driving chip has three output channels and generates eight control voltages to input into the first resistor string and the second resistor string; wherein, a control voltage VD1 generated at the first output channel connects to a port of the +V255 data signal voltage of the first resistor string; the control voltage VD1 also connects to a ground through resistors R1, R2 and R3 connected sequentially in series; a control voltage VD5 generated at the second output channel connects to a port of the +V127 data signal voltage of the first resistor string; a control voltage VD10 generated at the third output channel connects to a port of the +V0 data signal voltage of the first resistor string; wherein, the control voltage VD10 generated at the third output channel is also respectively connected to resistors R4 and R5; the resistor R5 is also connected in series with a resistor R6; the control voltage VD10 forms a control voltage VD9 through voltage dividing of the resistor R4 to connect to a port of the +V1 data signal voltage of the first resistor string; the control voltage VD10 forms a control voltage VD11 through voltage dividing of the resistor R5 to connect to a port of the −V0 data signal voltage of the second resistor string; the control voltage VD10 forms a control voltage VD12 through voltage dividing of the resistors R5 and R6 to connect to a port of the −V1 data signal voltage of the second resistor string; wherein, a voltage signal which is from voltage dividing between the resistors R1 and R2 connects to an analog buffer amplifier OP1 of the source electrode driving chip to be amplified to form a control voltage VD16 and connecting to a port of the −V127 data signal voltage port of the second resistor string; a voltage signal which is from voltage dividing between the resistors R2 and R3 connects to an analog buffer amplifier OP2 of the source electrode driving chip to be amplified to form a control voltage VD20 and connecting to a port of the −V255 data signal voltage of the second resistor string.

Wherein, the resistors R1, R2, and R3 are variable resistors.

Wherein, the resistors R4, R5, and R6 are variable resistors.

Wherein, the resistors R4, R5, and R6 are variable resistors.

The present invention also provides an LCD panel, comprising a source electrode driving module, a gate electrode driving module, and an LCD unit, wherein, the source electrode driving module is used for providing a data signal to the LCD unit, the gate electrode driving module is used for providing a scan signal to the LCD unit, wherein, the source electrode driving module adopts the source electrode driving module described above.

Comparing to the prior art, the LCD panel provided by the present invention, through using the P-GAMMA driving chip with fewer output channels, it can correct and generates the Gamma voltages so as to reduce the power consumption of the LCD panel, and reduce the difficulty of the driving circuit design and the fabrication process so as to save fabrication cost.

DETAILED DESCRIPTION OF THE PREFERRED EMBODIMENT

As described above, the present invention provides a source electrode driving module to solve the prior art problems. The source electrode driving module is for providing a data signal to the LCD unit, and it includes a Gamma correction chip and a source electrode driving chip. Wherein, the Gamma correction chip comprises a P-GAMMA (programmable gamma correction) driving chip having three to eight output channels; the source electrode driving chip comprises a first resistor string and a second resistor string. The first resistor string and the second resistor string are respectively formed by $2^n-2$ resistors connected in series. The first resistor string receives a portion of control voltages generated by the P-GAMMA driving chip, and they form $2^n$ Gamma voltages with positive polarity through voltage dividing. The second resistor string receives the other portion of control voltages generated by the P-GAMMA driving chip, and they form $2^n$ Gamma voltages with negative polarity through voltage dividing. The multiple control voltages generated by the P-GAMMA driving chip connect into the first resistor string and the second resistor string according to turning points of the Gamma curve of the LCD unit. Wherein, n is an integer, and $6 \leq n \leq 10$.

Wherein the number of the control voltage generated by the P-GAMMA driving chip is an even number, half of them is used to control the data signal voltage with positive polarity, and the other half of them is used to control the data signal voltage with negative polarity such that the data signal voltage with positive polarity and the data signal voltage with negative polarity of the Gamma curve form a symmetrical relationship.

Based on the above liquid crystal display panel, by using the P-GAMMA driving chip with fewer output channels to generate control voltages, and to achieve correction and generating Gamma voltage so as to reduce the power consumption of the LCD panel, decrease the design and manufacturing difficulty of the driving circuit, and reduce the manufacturing cost.

The following content combines with the drawings and the embodiment for describing the present invention in detail. It is obvious that the following embodiments are only some embodiments of the present invention. For the skilled persons of ordinary skill in the art without creative effort, the other embodiments obtained thereby are still covered by the present invention.

Embodiment 1

The embodiments use LCD panel with 8bit (a pixel displays $2^8$=256 grayscales totally) for explaining as an example.

Figure 1:
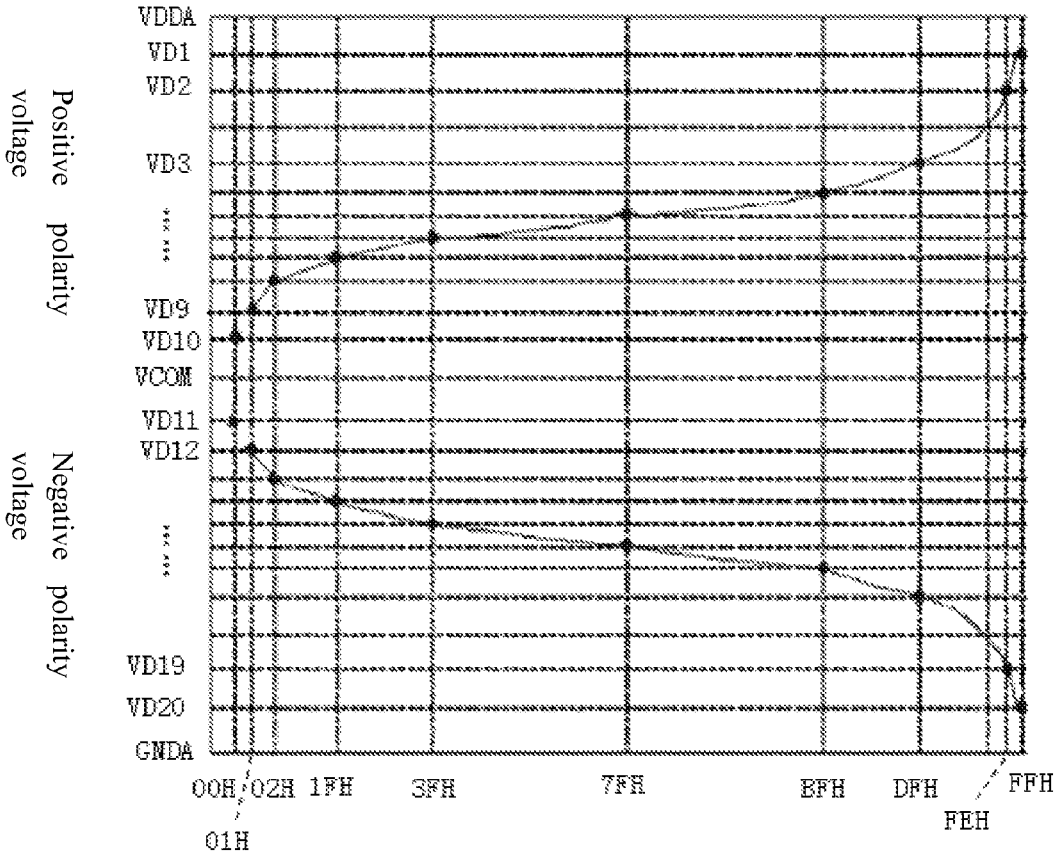
FIG. 1 (prior art)
FIG. 1 is a schematic Gamma curve diagram of an LCD panel in the conventional art.
Figure 2:
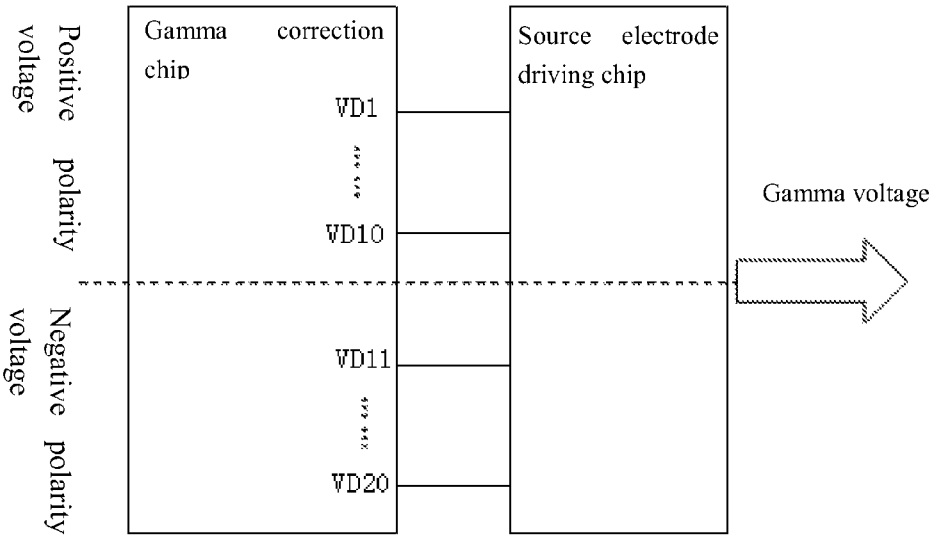
FIG. 2 (prior art)
FIG. 2 is a schematic block diagram for generating Gamma voltages in an LCD panel in the conventional art.
Figure 3:
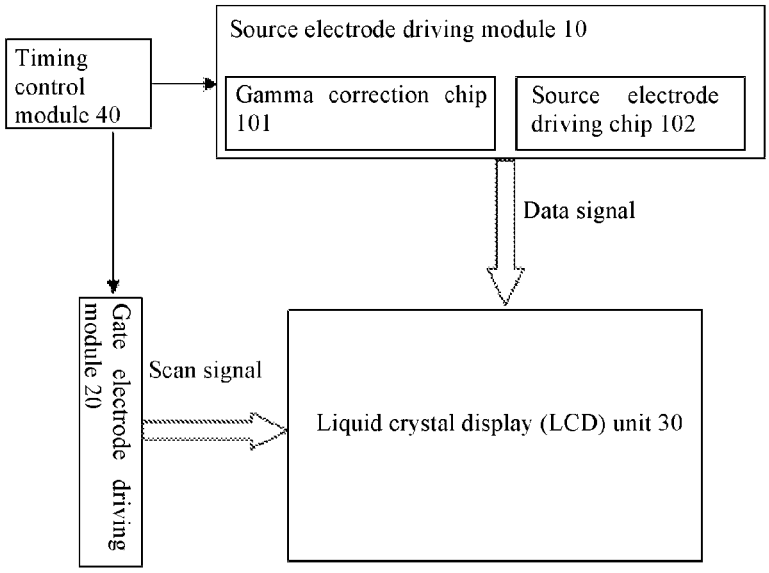
FIG. 3 is an exemplary schematic diagram of an LCD panel according to an embodiment of the present invention.

As shown in FIG. 3, an LCD panel provided by the present embodiment comprises a source electrode driving module 10, a gate electrode driving module 20 and a liquid crystal display unit 30, wherein the source electrode driving module 10 and the gate electrode driving module 20 are respectively controlled by a timing control module 40, and the source electrode driving module 10 and the gate electrode driving module 20 respectively provide a data signal and a scan signal to the liquid crystal display unit 30. The data signal is a Gamma voltage that makes the LCD panel display different grayscales. The source electrode driving module 10 comprises a Gamma correction chip 101 and a source electrode driving chip 102. The Gamma correction chip 101 provides control voltage to the source electrode driving chip 102 and controls the source electrode driving chip 102 to generate the Gamma voltage to the liquid crystal display (LCD) unit 30.

Figure 4:
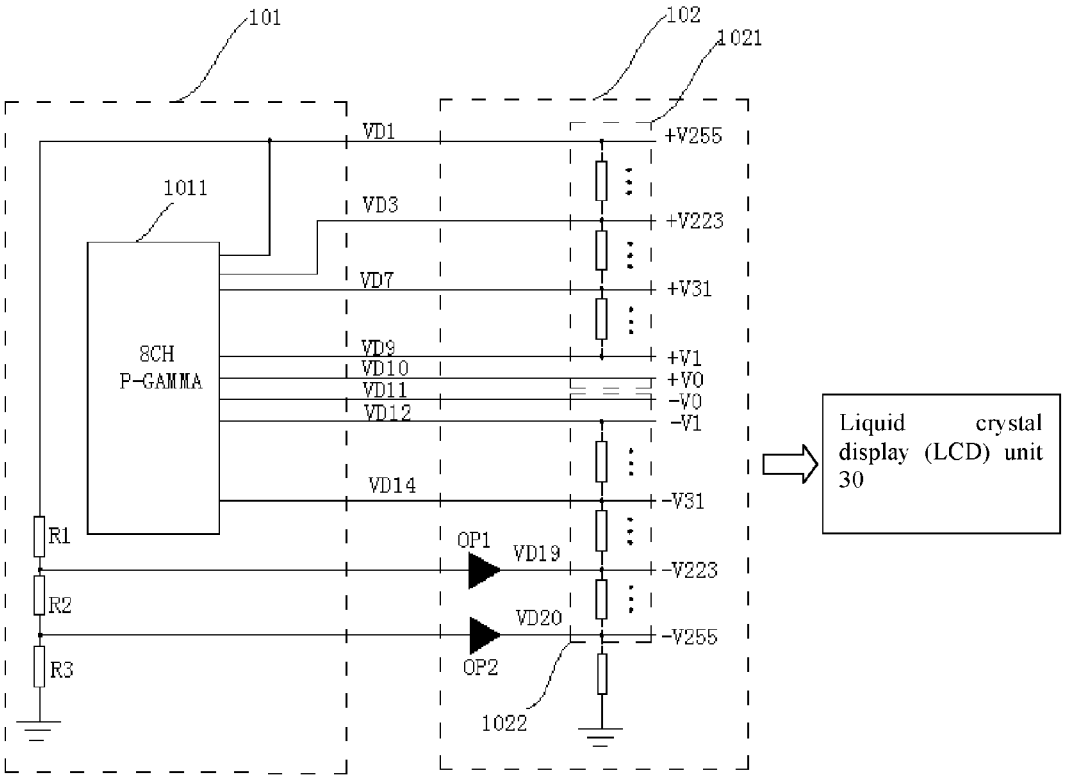
FIG. 4 is a circuit diagram for generating Gamma voltages in an LCD panel according to a first embodiment of the present invention.

With reference to FIG. 4, in the source electrode driving module 10 provided by the present embodiment, the Gamma correction chip 101 comprises a P-GAMMA driving chip 1011 with eight output channels (8CH P-GAMMA), and the P-GAMMA driving chip 1011 generates 10 control voltages (VD1, VD3, VD7, VD9, VD10, VD11, VD12, VD14, VD19 and VD20) for inputting to the source electrode driving chip 102. The source electrode driving chip 102 comprises a first resistor string 1021 and a second resistor string 1022. The first resistor string 1021 and the second resistor string 1022 are respectively formed by $2^8$ resistors connected in series. The first resistor string 1021 receives a portion of the control voltages generated by the P-GAMMA driving chip 1011. Through voltage dividing, it forms $2^8$ data signal voltages (Gamma voltages +V0~+V255) with positive polarity. The second resistor string 1022 receives the other portion of the control voltages generated by the P-GAMMA driving chip 1011. Through voltage dividing, it forms $2^8$ data signal voltages (Gamma voltages −V0~−V255) with negative polarity.

Specifically, the control voltage VD1 generated at the first output channel connects to a port of the +V255 data signal voltage of the first resistor string 1021. The control voltage VD1 also connects to a ground through resistors R1, R2 and R3 connected sequentially in series. The control voltage VD3 generated at the second output channel connects to a port of the +V233 data signal voltage of the first resistor string 1021. The control voltage VD7 generated at the third output channel connects to a port of the +V31 data signal voltage of the first resistor string 1021. The control voltage VD9 generated at the fourth output channel connects to a port of the +V1 data signal voltage of the first resistor string 1021. The control voltage VD10 generated at the fifth output channel connects to a port of the +V0 data signal voltage of the first resistor string 1021. The control voltage VD11 generated at the sixth output channel connects to a port of the −V0 data signal voltage of the second resistor string 1022. The control voltage VD12 generated at the seventh output channel connects to a port of the −V1 data signal voltage of the second resistor string 1022. The control voltage VD14 generated at the eighth output channel connects to a port of the −V31 data signal voltage of the second resistor string 1022.

Wherein, a voltage signal which is from voltage dividing between resistors R1 and R2 connects to an analog buffer amplifier OP1 of the source electrode driving chip 102 to be amplified to form a control voltage VD19 and connecting to a port of the −V233 data signal voltage of the second resistor string 1022. A voltage signal which is from voltage dividing between resistors R2 and R3 connects to an analog buffer amplifier OP2 of the source electrode driving chip 102 to be amplified to form a control voltage VD20 and connecting to a port of the −V255 data signal voltage of the second resistor string 1022. Wherein, the analog buffer amplifiers OP1 and OP2 are inherent analog buffer amplifiers of the source electrode driving chip 102.

In the present embodiment, because the +V0 and +V1 are respectively and directly controlled by VD10 and VD9, and the −V0 and −V1 are respectively and directly controlled by the VD11 and VD12, therefore, the +V0 and +V1, and the −V0 and −V1 are not required the voltage dividing resistors. As a result, the first resistor string 1021 and the second resistor string 1022 do not respectively have $2^8$ resistors, but they respectively have $2^8-1$ resistors. Furthermore, the first resistor string 1021 and the second resistor string 1022 all require connecting to the ground. In the present embodiment, the first resistor string 1021 is connected to the ground through resistors R1, R2 and R3 connected sequentially in series. The second resistor string 1022 is connected to the ground through another resistor.

Wherein the 10 control voltages generated by P-GAMMA driving chip 1011 is connected into the first resistor string 1021 and the second resistor string 1022 according to turning points of the Gamma curve of the LCD unit 30. Here, the turning points are inflection points of the Gamma curve. Through controlling the voltages at the turning points, it can control and correct the voltages near the turning points, and stable the Gamma curve. For example, in the Gamma curve representing 256 grayscales, the turning points are usually the grayscales of 00H, 01H, 02H, 1FH, 3FH, 7FH, BFH, DFH, FEH and FFH, that is, parameter points corresponding to the grayscales of 0, 1st, 2nd, 31rd, 63rd, 127rd, 191rd, 223rd, 254rd and 255rd. However, not every turn point requires connecting into the control voltage. The number of control voltages required to be connected into can be choose according to actual requirement.

For the control voltage which is directly connected to the port of the data signal voltage, the data signal voltage (Gamma voltage) is the control voltage itself. The data signal voltages at the other ports are generated by the control voltages at two sides of the ports through voltage dividing by the resistor string.

In this embodiment, the ten control voltages generated by the P-GAMMA driving chip 1011, five of them are used for controlling the data signal voltages with positive polarity. The other five of them are used for controlling the data signal voltages with negative polarity such that the Gamma curve of the data signal voltages with positive polarity and the data signal voltages with negative polarity forms a symmetrical relationship.

In this embodiment, the resistors R1, R2 and R3 are variable resistors.

The LCD panel provided above, wherein the source electrode driving module 10 controls and generates Gamma voltages through the P-GAMMA driving chip such that the Gamma voltages are adjustable. Besides, it utilizes the P-GAMMA driving chip with fewer output channels to reduce the power consumption of the LCD panel, and reduce the difficulty of the driving circuit design and the fabrication process so as to save fabrication cost.

Embodiment 2

Figure 5:
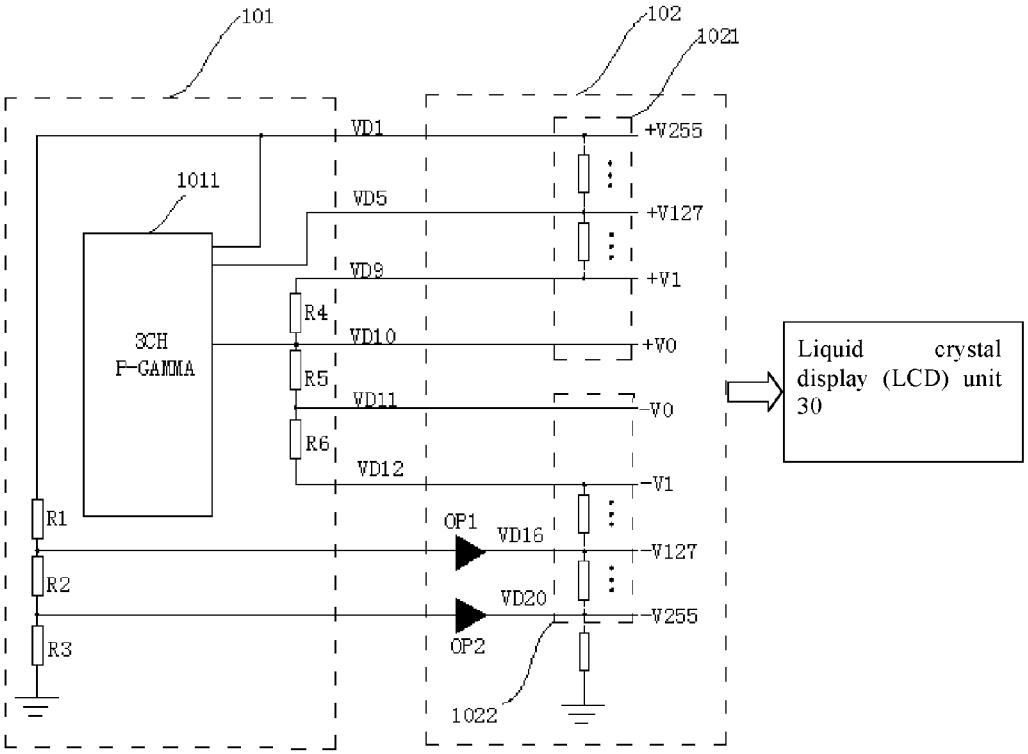
FIG. 5 is a circuit diagram for generating Gamma voltages in an LCD panel according to a second embodiment of the present invention.

With reference to FIG. 5, the difference is that: in the source electrode driving module 10 provided by the present embodiment, the Gamma correction chip 101 includes a P-GAMMA driving chip 1011 with three output channels (3CH P-GAMMA) to generate eight control voltages (VD1, VD5, VD9, VD10, VD11, VD12, VD16 and VD20) for inputting to the source electrode driving chip 102.

Specifically, the control voltage VD1 generated at the first output channel connects to a port of the +V255 data signal voltage of the first resistor string 1021. The control voltage VD1 also connects to a ground through resistors R1, R2 and R3 connected sequentially in series. The control voltage VD5 generated at the second output channel connects to a port of the +V127 data signal voltage of the first resistor string 1021. The control voltage VD10 generated at the third output channel connects to a port of the +V0 data signal voltage of the first resistor string 1021.

Wherein, the control voltage VD10 generated at the third output channel is respectively connected to resistors R4 and R5. The resistor R5 is also connected in series with a resistor R6. The control voltage VD10 forms the control voltage VD9 through voltage dividing of the resistor R4 to connect to a port of the +V1 data signal voltage of the first resistor string 1021. The control voltage VD10 forms the control voltage VD11 through voltage dividing of the resistor R5 to connect to a port of the −V0 data signal voltage of the second resistor string 1022. The control voltage VD10 forms the control voltage VD12 through voltage dividing of the resistors R5 and R6 to connect to a port of the −V1 data signal voltage of the second resistor string 1022.

Wherein, a voltage signal which is from voltage dividing between the resistors R1 and R2 connects to an analog buffer amplifier OP1 of the source electrode driving chip 102 to be amplified to form a control voltage VD16 and connecting to a port of the −V127 data signal voltage of the second resistor string 1022. A voltage signal which is from voltage dividing between resistors R2 and R3 connects to an analog buffer amplifier OP2 of the source electrode driving chip 102 to be amplified to form a control voltage VD20 and connecting to a port of the −V255 data signal voltage of the second resistor string 1022.

In this embodiment, the eight control voltages generated by the P-GAMMA driving chip 1011, four of them are used for controlling the data signal voltages with positive polarity. The other four of them are used for controlling the data signal voltages with negative polarity such that the Gamma curve of the data signal voltages with positive polarity and the data signal voltages with negative polarity forms a symmetrical relationship.

In this embodiment, the resistors R4, R5 and R6 are connected in series, the voltage generated form the third output channel connects to a point between the resistors R4 and R5. The other terminal of the resistor R4 connects with the control voltage VD9. A point between the resistors R4 and R5 connects with the control voltage VD10. A point between the resistors R5 and R6 connects with the control voltage VD11. The other terminal of the resistor R6 connects with the control voltage VD12. Wherein, the resistors R4, R5 and R6 are variable resistors.

Compared with the embodiment 1, the source electrode driving module 10 provided by the present embodiment uses the P-GAMMA driving chip with three output channels. In the case that can adjust the Gamma voltages, it further reduces the power consumption of the LCD panel, and reduces the difficulty of the driving circuit design and the fabrication process so as to save fabrication cost.

In summary, the LCD panel provided by the present invention, through using the P-GAMMA driving chip with fewer output channels, it can correct and generates the Gamma voltages so as to reduce the power consumption of the LCD panel, and reduce the difficulty of the driving circuit design and the fabrication process so as to save fabrication cost.

It should be noted that, herein, relational terms such as first and second, and the like are only used to distinguish one entity or operation from another entity or operation. It is not required or implied that these entities or operations exist any such relationship or order between them. Moreover, the terms "comprise," include," or any other variation thereof, are intended to cover a non-exclusive inclusion, such that a series of elements including the process, method, article or device that includes not only those elements but also other elements not expressly listed or further comprising such process, method, article or device inherent elements. Without more constraints, by the statement "comprises one . . . " element defined does not exclude the existence of additional identical elements in the process, method, article, or apparatus.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A source electrode driving module for providing a data signal to a liquid crystal display (LCD) unit, comprising: a Gamma correction chip and a source electrode driving chip, wherein, the Gamma correction chip comprises a P-GAMMA driving chip only having three to eight output channels, and resistors R1, R2 and R3; the P-GAMMA driving chip is used for generating multiple control voltages providing to the source electrode driving chip;

the source electrode driving chip comprises a first resistor string and a second resistor string; the first resistor string and the second resistor string are respectively formed by $2^n-2$ resistors connected in series; the first resistor string receives a portion of the control voltages generated by the P-GAMMA driving chip, and through voltage dividing to form $2^n$ data signal voltages with positive polarity; the second resistor string receives the other portion of the control voltages generated by the P-GAMMA driving chip, and through voltage dividing to form $2^n$ data signal voltages with negative polarity; and the multiple control voltages generated by the P-GAMMA driving chip connect into the first resistor string and the second resistor string according to turning points of a Gamma curve of the LCD unit, wherein, n is an integer, and $6 \leq n \leq 10$;

wherein, a control voltage VD1 generated at a first output channel of the P-GAMMA driving chip is connected to the first resistor string of the source electrode driving chip and also connected to a ground through the resistors R1, R2 and R3 connected sequentially in series; and wherein, a voltage signal which is from voltage dividing between the resistors R1 and R2 connects to a first analog buffer amplifier OP1 of the source electrode driving chip to be amplified to form one of the multiple control voltages and connecting to the second resistor string; a voltage signal which is from voltage dividing between the resistors R2 and R3 connects to a second analog buffer amplifier OP2 of the source electrode driving chip to be amplified to form another one of the multiple control voltages and connecting to the second resistor string.

2. The source electrode driving module according to claim 1, wherein, the value of n is eight, and the data signal voltages with positive polarity are +V0~+V255, and the data signal voltages with negative polarity are −V0~−V255.

3. The source electrode driving module according to claim 1, wherein, the number of the control voltages generated by the P-GAMMA driving chip is an even number, a half of the control voltages is used to control the data signal voltages with positive polarity, and the other half of the control voltages is used to control the data signal voltages with negative polarity such that the data signal voltages with positive polarity and the data signal voltages with negative polarity of the Gamma curve form a symmetrical relationship.

4. The source electrode driving module according to claim 3, wherein, the value of n is eight, and the data signal voltages with positive polarity are +V0~+V255, and the data signal voltages with negative polarity are −V0~−V255.

5. The source electrode driving module according to claim 4, wherein, the P-GAMMA driving chip has eight output channels and generates ten control voltages to input into the first resistor string and the second resistor string; wherein, the control voltage VD1 generated at the first output channel connects to a port of the +V255 data signal voltage of the first resistor string; a control voltage VD3 generated at the second output channel connects to a port of the +V233 data signal voltage of the first resistor string; a control voltage VD7 generated at the third output channel connects to a port of the +V31 data signal voltage of the first resistor string; a control voltage VD9 generated at the fourth output channel connects to a port of the +V1 data signal voltage of the first resistor string; a control voltage VD10 generated at the fifth output channel connects to the a port of the +V0 data signal voltage of the first resistor string; a control voltage VD11 generated at the sixth output channel connects to a port of the −V0 data signal voltage of the second resistor string; a control voltage VD12 generated at the seventh output channel connects to a port of the −V1 data signal voltage of the second resistor string; a control voltage VD14 generated at the eighth output channel connects to a port of the −V31 data signal voltage of the second resistor string; wherein, the voltage signal which is from voltage dividing between the resistors R1 and R2 connects to the first analog buffer amplifier OP1 of the source electrode driving chip to be amplified to form a control voltage VD19 and connecting to a port of the −V233 data signal voltage of the second resistor string; the voltage signal which is from voltage dividing between the resistors R2 and R3 connects to the second analog buffer amplifier OP2 of the source electrode driving chip to be amplified to form a control voltage VD20 and connecting to a port of the −V255 data signal voltage of the second resistor string.

6. The source electrode driving module according to claim 5, wherein, the resistors R1, R2, and R3 are variable resistors.

7. The source electrode driving module according to claim 4, wherein, the P-GAMMA driving chip has three output channels and generates eight control voltages to input into the first resistor string and the second resistor string; wherein, a control voltage VD1 generated at the first output channel connects to a port of the +V255 data signal voltage of the first resistor string; a control voltage VD5 generated at the second output channel connects to a port of the +V127 data signal voltage of the first resistor string; a control voltage VD10 generated at the third output channel connects to a port of the +V0 data signal voltage of the first resistor string; wherein, the control voltage VD10 generated at the third output channel is also respectively connected to resistors R4 and R5; the resistor R5 is also connected in series with a resistor R6; the control voltage VD10 forms a control voltage VD9 through voltage dividing of the resistor R4 to connect to a port of the +V1 data signal voltage of the first resistor string; the control voltage VD10 forms a control voltage VD11 through voltage dividing of the resistor R5 to connect to a port of the −V0 data signal voltage of the second resistor string; the control voltage VD10 forms a control voltage VD12 through voltage dividing of the resistors R5 and R6 to connect to a port of the −V1 data signal voltage of the second resistor string; wherein, the voltage signal which is from voltage dividing between the resistors R1 and R2 connects to the first analog buffer amplifier OP1 of the source electrode driving chip to be amplified to form a control voltage VD16 and connecting to a port of the −V127 data signal voltage port of the second resistor string; the voltage signal which is from voltage dividing between the resistors R2 and R3 connects to the second analog buffer amplifier OP2 of the source electrode driving chip to be amplified to form a control voltage VD20 and connecting to a port of the −V255 data signal voltage of the second resistor string.

8. The source electrode driving module according to claim 7, wherein, the resistors R4, R5, and R6 are variable resistors.

9. The source electrode driving module according to claim 7, wherein, the resistors R1, R2, and R3 are variable resistors.

10. The source electrode driving module according to claim 9, wherein, the resistors R4, R5, and R6 are variable resistors.

11. A liquid crystal display (LCD) panel comprising a source electrode driving module, a gate electrode driving module, and an LCD unit, wherein, the source electrode driving module is used for providing a data signal to the LCD unit, the gate electrode driving module is used for providing a scan signal to the LCD unit, wherein, the source electrode driving module comprises a Gamma correction chip and a source electrode driving chip, wherein, the Gamma correction chip comprises a P-GAMMA driving chip only having three to eight output channels, and resistors R1, R2 and R3; the P-GAMMA driving chip is used for generating multiple control voltages providing to the source electrode driving chip;

the source electrode driving chip comprises a first resistor string and a second resistor string; the first resistor string and the second resistor string are respectively formed by $2^n-2$ resistors connected in series; the first resistor string receives a portion of the control voltages generated by the P-GAMMA driving chip, and through voltage dividing to form $2^n$ data signal voltages with positive polarity; the second resistor string receives the other portion of the control voltages generated by the P-GAMMA driving chip, and through voltage dividing to form $2^n$ data signal voltages with negative polarity; and the multiple control voltages generated by the P-GAMMA driving chip connect into the first resistor string and the second resistor string according to turning points of a Gamma curve of the LCD unit, wherein, n is an integer, and $6 \le n \le 10$;

wherein, a control voltage VD1 generated at a first output channel of the P-GAMMA driving chip is connected to the first resistor string of the source electrode driving chip and also connected to a ground through the resistors R1, R2 and R3 connected sequentially in series; and wherein, a voltage signal which is from voltage dividing between the resistors R1 and R2 connects to a first analog buffer amplifier OP1 of the source electrode driving chip to be amplified to form one of the multiple control voltages and connecting to the second resistor string; a voltage signal which is from voltage dividing between the resistors R2 and R3 connects to a second analog buffer amplifier OP2 of the source electrode driving chip to be amplified to form another one of the multiple control voltages and connecting to the second resistor string.

12. The LCD panel according to claim 11, wherein, the value of n is eight, and the data signal voltages with positive polarity are +V0~+V255, and the data signal voltages with negative polarity are −V0~−V255.

13. The LCD panel according to claim 11, wherein, the number of the control voltages generated by the P-GAMMA driving chip is an even number, a half of the control voltages is used to control the data signal voltages with positive polarity, and the other half of the control voltages is used to control the data signal voltages with negative polarity such that the data signal voltages with positive polarity and the data signal voltages with negative polarity of the Gamma curve form a symmetrical relationship.

14. The LCD panel according to claim 12, wherein, the value of n is eight, and the data signal voltages with positive polarity are +V0~+V255, and the data signal voltages with negative polarity are −V0~−V255.

15. The LCD panel according to claim 14, wherein, the P-GAMMA driving chip has eight output channels and generates ten control voltages to input into the first resistor string and the second resistor string; wherein, the control voltage VD1 generated at the first output channel connects to a port of the +V255 data signal voltage of the first resistor string; a control voltage VD3 generated at the second output channel connects to a port of the +V233 data signal voltage of the first resistor string; a control voltage VD7 generated at the third output channel connects to a port of the +V31 data signal voltage of the first resistor string; a control voltage VD9 generated at the fourth output channel connects to a port of the +V1 data signal voltage of the first resistor string; a control voltage VD10 generated at the fifth output channel connects to the a port of the +V0 data signal voltage of the first resistor string; a control voltage VD11 generated at the sixth output channel connects to a port of the −V0 data signal voltage of the second resistor string; a control voltage VD12 generated at the seventh output channel connects to a port of the −V1 data signal voltage of the second resistor string; a control voltage VD14 generated at the eighth output channel connects to a port of the −V31 data signal voltage of the second resistor string; wherein, the voltage signal which is from voltage dividing between the resistors R1 and R2 connects to the first analog buffer amplifier OP1 of the source electrode driving chip to be amplified to form a control voltage VD19 and connecting to a port of the −V233 data signal voltage of the second resistor string; the voltage signal which is from voltage dividing between the resistors R2 and R3 connects to the second analog buffer amplifier OP2 of the source electrode driving chip to be amplified to form a control voltage VD20 and connecting to a port of the −V255 data signal voltage of the second resistor string.

16. The LCD panel according to claim 15, wherein, the resistors R1, R2, and R3 are variable resistors.

17. The LCD panel according to claim 14, wherein, the P-GAMMA driving chip has three output channels and generates eight control voltages to input into the first resistor string and the second resistor string; wherein, a control voltage VD1 generated at the first output channel connects to a port of the +V255 data signal voltage of the first resistor string; a control voltage VD5 generated at the second output channel connects to a port of the +V127 data signal voltage of the first resistor string; a control voltage VD10 generated at the third output channel connects to a port of the +V0 data signal voltage of the first resistor string; wherein, the control voltage VD10 generated at the third output channel is also respectively connected to resistors R4 and R5; the resistor R5 is also connected in series with a resistor R6; the control voltage VD10 forms a control voltage VD9 through voltage dividing of the resistor R4 to connect to a port of the +V1 data signal voltage of the first resistor string; the control voltage VD10 forms a control voltage VD11 through voltage dividing of the resistor R5 to connect to a port of the −V0 data signal voltage of the second resistor string; the control voltage VD10 forms a control voltage VD12 through voltage dividing of the resistors R5 and R6 to connect to a port of the −V1 data signal voltage of the second resistor string; wherein, the voltage signal which is from voltage dividing between the resistors R1 and R2 connects to the first analog buffer amplifier OP1 of the source electrode driving chip to be amplified to form a control voltage VD16 and connecting to a port of the −V127 data signal voltage port of the second resistor string; the voltage signal which is from voltage dividing between the resistors R2 and R3 connects to the second analog buffer amplifier OP2 of the source electrode driving chip to be amplified to form a control voltage VD20 and connecting to a port of the −V255 data signal voltage of the second resistor string.

18. The LCD panel according to claim according to claim 17, wherein, the resistors R4, R5, and R6 are variable resistors.

19. The LCD panel according to claim according to claim 17, wherein, the resistors R1, R2, and R3 are variable resistors.

20. The LCD panel according to claim according to claim 19, wherein, the resistors R4, R5, and R6 are variable resistors.

* * * * *